US008441212B2

(12) United States Patent
Kim

(10) Patent No.: US 8,441,212 B2
(45) Date of Patent: May 14, 2013

(54) SYSTEM AND METHOD FOR DRIVING LIGHT EMITTING DEVICES USING WIRELESS COMMUNICATION MODULE

(76) Inventor: Won Hae Kim, Seongnam-si (KR)

( * ) Notice: Subject to any disclaimer, the term of this patent is extended or adjusted under 35 U.S.C. 154(b) by 666 days.

(21) Appl. No.: 12/688,982

(22) Filed: Jan. 18, 2010

(65) Prior Publication Data

US 2011/0127916 A1 Jun. 2, 2011

(30) Foreign Application Priority Data

Nov. 30, 2009 (KR) ..... 10-2009-0117201

(51) Int. Cl.
*H05B 37/00* (2006.01)
*G08B 21/00* (2006.01)

(52) U.S. Cl.
USPC ..... 315/312; 315/315; 340/635

(58) Field of Classification Search ..... 315/291–297, 315/302, 307, 308, 312, 316–318, 360, 362; 340/310.11, 635, 641, 642
See application file for complete search history.

(56) References Cited

U.S. PATENT DOCUMENTS 5,095,502 A * 3/1992 Finzel ..... 379/40
2008/0143493 A1* 6/2008 Nam et al. ..... 340/310.11
2010/0045205 A1* 2/2010 Bergman et al. ..... 315/294

* cited by examiner

*Primary Examiner* — Jimmy Vu
(74) *Attorney, Agent, or Firm* — John K. Park; Park Law Firm

(57) ABSTRACT

Disclosed herein is a system for driving light emitting devices. The system for driving light emitting devices includes a main light emitting device and at least one sub-light emitting device. The main light emitting device includes a first communication unit for exchanging information with a central monitoring server and a close sub-light emitting device using a wireless communication module, a first light emitting unit having at least one light emitting element, and a first control unit for controlling the light emission of the first light emitting unit, and transmitting a command signal for controlling the sub-light emitting device to the sub-light emitting device. The sub-light emitting device includes a second communication unit for exchanging information with the main light emitting device, a second light emitting unit having at least one light emitting element, and a second control unit for controlling the light emission of the second light emitting unit.

6 Claims, 6 Drawing Sheets

SYSTEM AND METHOD FOR DRIVING LIGHT EMITTING DEVICES USING WIRELESS COMMUNICATION MODULE

BACKGROUND OF THE INVENTION

1. Field of the Invention

The present invention relates generally to a system and method for driving light emitting devices using a wireless communication module, and, more particularly, to a system and method for driving light emitting devices using a wireless communication module which enable signals to be exchanged between a central processing server and light emitting devices located far away from each other using a commercial wireless communication network, and enable signals to be exchanged between the light emitting devices located within a local area using a local area wireless communication module.

2. Description of the Related Art

Light emitting devices such as fog guidance lamps are installed along roads or around facilities at predetermined intervals, and guide cars or walkers to locations. Conventional light emitting devices are connected to a central monitoring system by wiring, and are manually controlled by a manager. Furthermore, the light emitting devices are manually managed by workers.

Accordingly, in a conventional system for driving light emitting devices, the central monitoring system is connected to respective light emitting devices by a wired network. This results in cost and time increases regarding implementation.

Furthermore, in the conventional system for driving light emitting devices, respective light emitting devices receive power from the outside through a wired network along which they are implemented. Accordingly, when a failure occurs in a part of the wired network, the light emitting devices cannot receive power, so that it is impossible to power them. Furthermore, the central monitoring device can control the respective light emitting devices in only one way. Accordingly, when the light emitting device fails, a user cannot easily become aware of the presence of a failure or the object responsible therefor.

SUMMARY OF THE INVENTION

Accordingly, the present invention has been made keeping in mind the above problems occurring in the prior art, and an object of the present invention is to provide a system and method for driving light emitting devices using a wireless communication module which is capable of minimizing inconveniences in its construction and management.

Another object of the present invention is to provide a system and method for driving light emitting devices using a wireless communication module which enables bidirectional control between a central processing server and light emitting devices and between the light emitting devices themselves.

Still another object of the present invention is to provide a system and method for driving light emitting devices using a wireless communication module which is capable of preventing a dangerous situation from arising because of a failure using the self-diagnosis function of light emitting devices.

Still another object of the present invention is to provide a system and method for driving light emitting devices using a wireless communication module which enable light emitting devices to produce electric energy and to operate using it.

In order to accomplish the above object, the present invention provides a system for driving light emitting devices, including a main light emitting device comprising a first communication unit for exchanging information with a central monitoring server and a close sub-light emitting device using a wireless communication module, a first light emitting unit having at least one light emitting element, and a first control unit for controlling light emission of the first light emitting unit based on command signals received from the central monitoring server, and transmitting a command signal for controlling the sub-light emitting device, which belongs to the command signals received from the central monitoring server, to the sub-light emitting device through the first communication unit; and at least one sub-light emitting device comprises a second communication unit for exchanging information with the main light emitting device, a second light emitting unit having at least one light emitting element, and a second control unit for controlling light emission of the second light emitting unit based on the command signal received from the main light emitting unit.

The main light emitting device includes a first sensing unit for sensing the status information of the first light emitting unit, and the sub-light emitting device comprises a second sensing unit for sensing the status information of the second light emitting unit; and the main light emitting device transmits the status information of the first light emitting unit sensed by the first sensing unit and/or the status information of the second light emitting unit sensed by the second sensing unit and received from the sub-light emitting device to the central monitoring server through the first communication unit.

The status information includes information about a battery mounted in each of the main light emitting device and the sub-light emitting device, lifetime information of the first and second light emitting units, and status information of the second communication unit included in the sub-light emitting device.

Each of the main light emitting device and the sub-light emitting device further comprises a charging module for converting solar energy into electric energy and supplying the electric energy to the battery.

The central monitoring server and the main light emitting device communicate with each other over a wireless communication network using any one of WCDMA, CDMA, or GSM methods; and the main light emitting device and the sub-light emitting device communicate with each other using any one of ZigBee, Bluetooth, and infrared ray methods.

Additionally, the present invention provides a method of driving light emitting devices using a wireless communication module, including driving a main light emitting device to emit light based on command signals received from a central monitoring server using the wireless communication module; transmitting a command signal for controlling the sub-light emitting device close to the main light emitting device, which belongs to the command signals received from the central monitoring server, to the sub-light emitting device; and driving the sub-light emitting device to emit light in response to the command signal received from the central monitoring server.

The drive method further includes sensing the status of the main light emitting device and the sub-light emitting device; and transmitting the sensed status information of the main light emitting device and the sensed status information of the sub-light emitting device to the central monitoring server.

The status information includes information about a battery mounted in each of the main light emitting device and the sub-light emitting device, the lifetime information of first and second light emitting units, and the status information of a second communication unit included in the sub-light emitting device.

The drive method further includes converting solar energy into electric energy and supplying the electric energy to the battery.

The central monitoring server and the main light emitting device communicate with each other over a wireless communication network using any one of WCDMA, CDMA and GSM schemes; and the main light emitting device and the sub-light emitting device communicate with each other using any one of ZigBee, Bluetooth and infrared ray methods.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
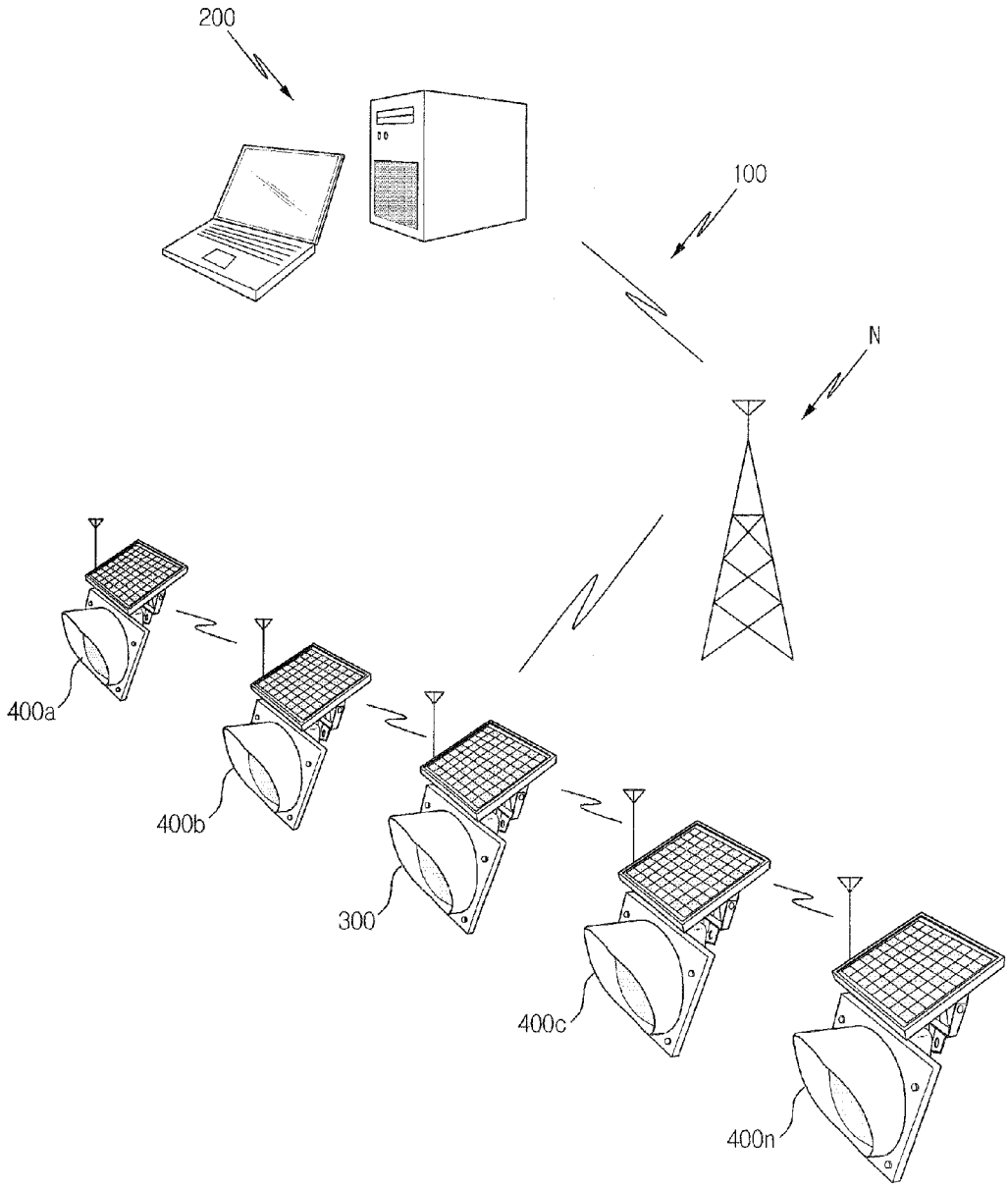
FIG. 1 is a diagram illustrating the configuration of a system for driving light emitting devices using a wireless communication module according to an embodiment of the present invention.

Reference now should be made to the drawings, in which the same reference numerals are used throughout the different drawings to designate the same or similar components. Furthermore, if in the following description of the present invention, detailed descriptions of related well-known technologies may unnecessarily make the gist of the present invention unclear, and so detailed descriptions thereof will be omitted in the following description.

A system and method for driving light emitting devices according to an embodiment of the present invention will be described below in detail with reference to the accompanying drawings.

FIG. 1 is a diagram illustrating the configuration of a system for driving light emitting devices using a wireless communication module according to an embodiment of the present invention. As shown in FIG. 1, the system 100 for driving light emitting devices according to the embodiment of the present invention includes a central monitoring server 200, a main light emitting device 300, and one or more sub-light emitting devices 400*a*, 400*b*, 400*c*, . . . , 400*n*.

The central monitoring server 200 transmits a command signal to control the main light emitting device 300 and the sub-light emitting devices 400*a*, 400*b*, 400*c*, . . . , 400*n* using a wireless communication module. The central monitoring server 200 also receives the status information of the main light emitting device 300 and the sub-light emitting devices 400*a*, 400*b*, 400*c*, . . . , 400*n* using the wireless communication module.

The wireless communication module according to the present invention may be implemented using a commercial network N such as a Wideband Code Division Multiple Access (WCDMA) network, a Code Division Multiple Access (CDMA) network or a Global System for Mobile communication (GSM) network.

The main light emitting device 300 emits light based on command signals received from the central monitoring server 200, and then transmits a received command signal to a sub-light emitting device 400, or receives the status information of the sub-light emitting device 400 and transmits it to the central monitoring server 200.

The sub-light emitting device 400 emits light based on the command signal received from the central monitoring sever 200 through the main light emitting device 300, and transmits its status information to the main light emitting device 300. Each of the main light emitting device 300 and the sub-light emitting devices 400 may includes volatile memory to store status information and the like.

The main light emitting device 300 and the sub-light emitting device 400 may be implemented using guidance lamps or street lamps located on buildings or streets at predetermined intervals.

Since the main light emitting device 300 receives the command signal from the central monitoring server 200 and transmits it to the sub-light emitting device 400, the main light emitting device 300 and the sub-light emitting device 400 can be defined as a master device and a slave device, respectively. Since the central monitoring server 200 and the main light emitting device 300 may be located far away from each other, it is preferred that a normal communication network be used to connect them to each other. However, the main light emitting device 300 and the sub-light emitting device 400 can communicate with each other using local area communication such as ZigBee communication.

Accordingly, since the system for driving light emitting devices according to the present invention is implemented using a wireless communication module, inconveniences in its construction and management can be minimized compared to that of conventional drive systems which depend on equipment which is wired.

Figure 2:
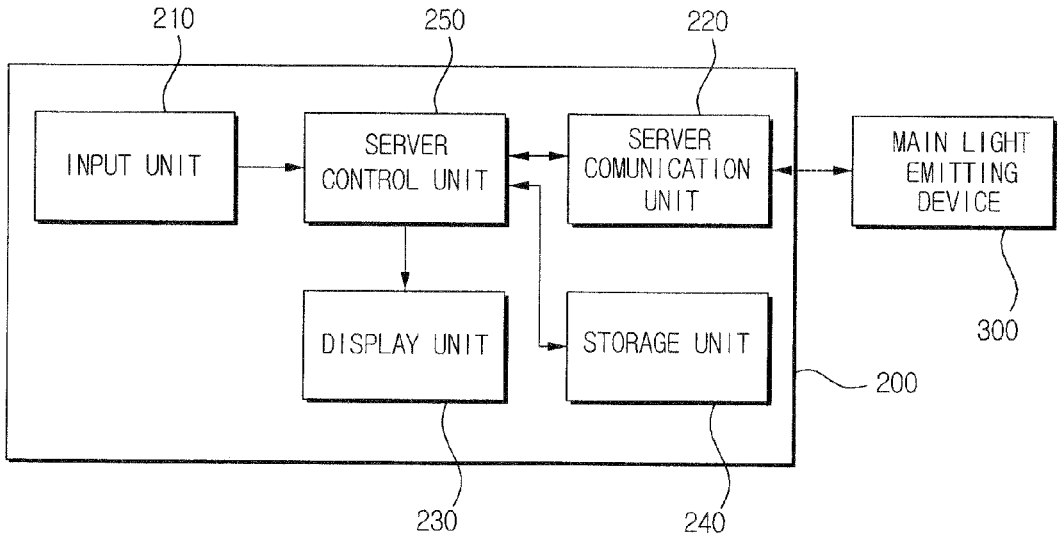
FIG. 2 is a block diagram showing the configuration of a central monitoring server according to an embodiment of the present invention.

FIG. 2 is a block diagram showing the configuration of a central monitoring server 200 included in the system for driving light emitting devices according to an embodiment of the present invention.

As shown in FIG. 2, the central monitoring server 200 according to an embodiment of the present invention includes an input unit 210, a server communication unit 220, a display unit 230, a storage unit 240, and a server control unit 250. The central monitoring server 200 may be implemented using high-capacity hardware or a terminal such as a Personal Computer (PC), a notebook computer, a portable telephone or a Personal Digital Assistants (PDA).

The input unit 210 receives a command to control the main light emitting device 300 and the sub-light emitting device 400. The input unit 210 may be implemented using a remote controller located outside the central monitoring server 200 or using a key pad or a mouse provided on a side of the central monitoring server 200.

The server communication unit 220 transmits the command received through the input unit 210 to the main light emitting device 300 and the sub-light emitting device 400, and receives the status information of the main light emitting device 300 and the sub-light emitting device 400.

The display unit 230 displays the status information of the main light emitting device 300 and the sub-light emitting device 400. It will be apparent that the display unit 230 may display any type of information required to operate the central monitoring server 200.

The storage unit 240 stores command information required to operate both the main light emitting device 300 and the sub-light emitting device 400, the sensed status information of the main light emitting device 300, and the sensed status information of the sub-light emitting device 400. In this case, the command information required to operate both the main light emitting device 300 and the sub-light emitting device 400 may include information about the on/off status of a power supply and the intensity of light emission, which may be stored in various forms according to the surrounding conditions of the main light emitting device 300 and the sub-light emitting device 400. The status information of the main light emitting device 300 and the sub-light emitting device 400 may include information about batteries mounted therein, lifetime information of first and second light emitting units 320 and 420, and the status information of a second communication unit 410 included in the sub-light emitting device 400.

In detail, the storage unit 240 receives information required in order to perform wireless communication with the main light emitting device 300 and the sub-light emitting device 400 over a commercial network N. The storage unit 240 stores status information, including information about the operation of the main light emitting device 300 and the sub-light emitting device 400, information about the charge level of a mounted battery, and information about the operation of the wireless communication module, for each of the IDs allotted to the main light emitting device 300 and the sub-light emitting device 400.

The server control unit 250 controls the light emission of the main light emitting device 300 and the sub-light emitting device 400 based on the command signal received through the input unit 210. The server control unit 250 receives the status information of the main light emitting device 300 and the sub-light emitting device 400, and displays them on the display unit 230. The server control unit 250 is generally formed of high-capacity hardware or software embedded therein, and stores the status information of the main light emitting device 300 and the sub-light emitting device 400 in the storage unit 240 in real time.

Figure 3:
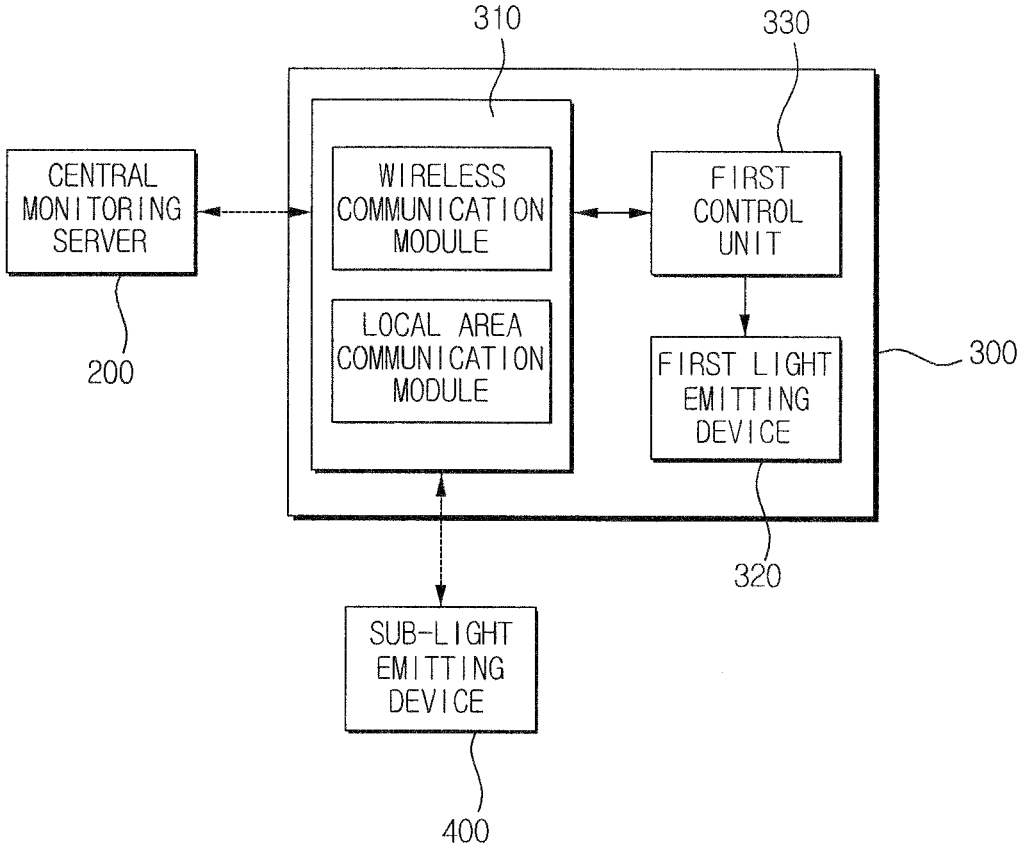
FIG. 3 is a block diagram showing the configuration of a main light emitting device according to an embodiment of the present invention.

FIG. 3 is a block diagram showing the configuration of a main light emitting device 300 included in the system for driving light emitting devices according to an embodiment of the present invention.

Referring to FIG. 3, the main light emitting device 300 according to an embodiment of the present invention includes a first communication unit 310, a first light emitting unit 320, and a first control unit 330.

The first communication unit 310 exchanges information with the central monitoring server 200 and a close sub-light emitting device 400 using a wireless communication module. The first communication unit 310 includes a wireless communication module 310*a* for communicating with the central monitoring server 200 and a local area wireless communication module 310*b* for communicating with the sub-light emitting device 400. The wireless communication module 310*a* is implemented using a commercial network N such as a MCDMA network, a CDMA network, or a GSM network, and the local area wireless communication module 310*b* is implemented using a communication method such as a ZigBee method, a Bluetooth method, or an infrared ray method.

The first light emitting unit 320 includes at least one light emitting element, and emits light based on a command signal received from the central monitoring server 200 through the first communication unit 310. Although a light emitting element of the first light emitting unit 320 is preferably implemented using a Light Emitting Diode (LED) with high luminance and excellent power efficiency, some other light emitting elements are also applicable.

The first control unit 330 controls the light emission of the first light emitting unit 320 based on the command signal received from the central monitoring server 200. The first control unit 330 transmits a command signal for controlling the sub-light emitting device 400, which belongs to the command signals received from the central monitoring server 200, to the sub-light emitting device 400 through the first communication unit 310. The first control unit 330 may be implemented using an electronic circuit, including a microcomputer, and software.

Figure 4:
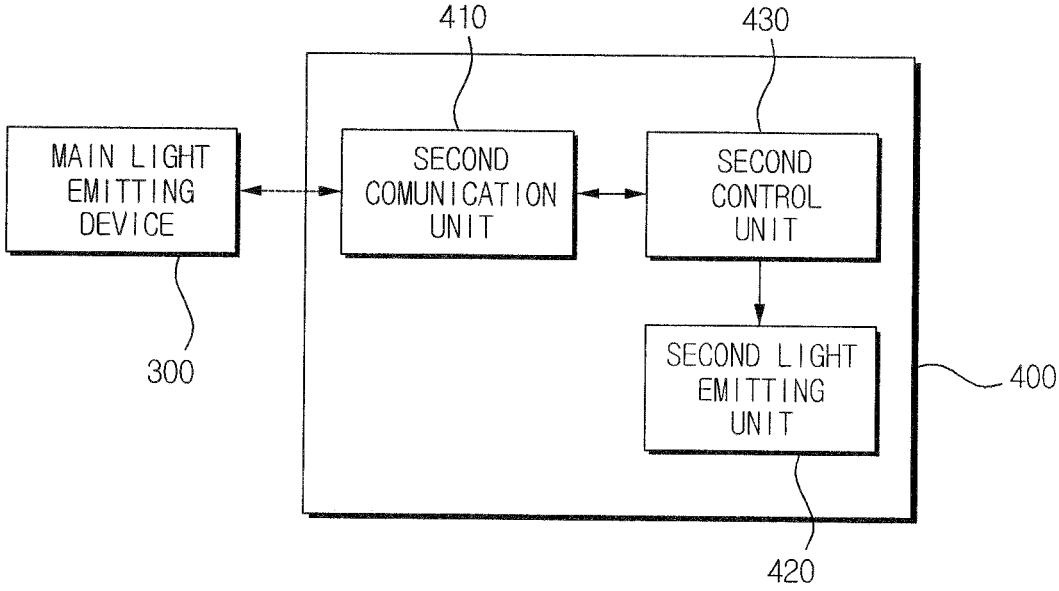
FIG. 4 is a block diagram showing the configuration of a sub-light emitting device according to an embodiment of the present invention.

FIG. 4 is a block diagram showing the configuration of a sub-light emitting device included in the system for driving light emitting devices according to an embodiment of the present invention.

As shown in FIG. 4, the sub-light emitting device 400 according to an embodiment of the present invention includes a second communication unit 410, a second light emitting unit 420, and a second control unit 430.

The second communication unit 410 exchanges information with the main light emitting device 300. In detail, the second communication unit 410 receives a command signal from the central monitoring server 200 through the main light emitting device 300.

The second light emitting unit 420 has the same construction as the first light emitting unit 320 of the main light emitting device 300, and thus a redundant description thereof is omitted here.

The second control unit 430 controls the light emission of the second light emitting unit 420 based on the command signal received from the main light emitting unit 300. Like the first control unit 330 of the main light emitting device 300, the second control unit 430 may be implemented using an electronic circuit, including a microcomputer, and software.

Figure 5:
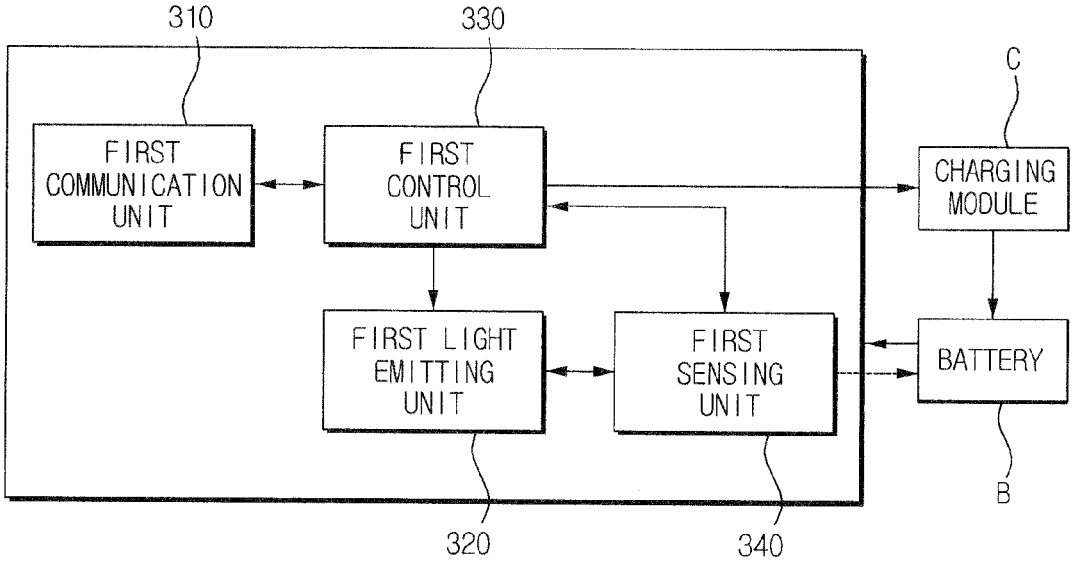
FIG. 5 is a block diagram showing the configuration of a main light emitting device according to another embodiment of the present invention.

FIG. 5 is a block diagram showing the configuration of a main light emitting device according to another embodiment of the present invention. As shown in FIG. 5, the main light emitting device 300 according to another embodiment of the present invention includes a battery B and a charging module C. Like the main light emitting device 300, a sub-light emitting device 400 includes a battery B and a charging module C.

The batteries B supply power required for the light emission of the first emitting unit 320 and the second light emitting unit 420. The batteries B are detachably mounted in the main light emitting device 300 and the sub-light emitting device 400, respectively.

The charging module C converts solar energy into electric energy, and supplies the electric energy to the battery B. The charging module C includes a receiving module for receiving the solar energy and a converter for converting the received solar energy into a predetermined voltage, which can be supplied to a light emitting unit.

Meanwhile, the main light emitting device 300 and the sub-light emitting device 400 may further include a first sensing unit 340 and a second sensing unit 440, respectively. The first sensing unit 340 senses the status information of the main light emitting device 300, and the second sensing unit 440 senses the status information of the sub-light emitting device 400. The first sensing unit 340 and the second sensing unit 440 may be implemented using a variety of types of sensors for sensing the levels of the batteries B and the brightness of the first light emitting unit 320 and the second light emitting unit 420.

Here, the status information of the light emitting device may include the status information of the battery B, the lifetime information of first and second light emitting units 320 and 420, and the status information of the second communication unit 410 included in the sub-light emitting device 400.

The status information of the battery B may include the presence of a failure and the charge level information thereof. The first control unit 330 and the second control unit 430 control the first sensing unit 340 and the second sensing unit 440 to sense the presence of a failure and the charge level information of the batteries B. When the charge level of the battery B is equal to or greater than a reference value, the main light emitting device 300 or the sub-light emitting device 400 itself may charge the battery B using the charging module C. Alternatively, the main light emitting device 300 and the sub-light emitting device 400 transmit the charge level information of the battery B to the central monitoring server 200 so that the central monitoring server 200 can charge the battery B.

Moreover, the first control unit 330 and the second control unit 430 sense the lifetime information of the first light emitting unit 320 and the second light emitting unit 420 through the first sensing unit 340 and the second sensing unit 440, and transmit sensing results to the central monitoring server 200.

The status information of the second communication unit 410 indicates whether the second communication unit 410 is in a normal communication state or an abnormal communication state. The main light emitting device 300 transmits a kind of echo signal, determines that the communication state is abnormal if there is no response thereto, and transmits the ID of the sub-light emitting device 400 and information about the abnormal communication state to the central monitoring server 200.

The status information of the main light emitting device 300 sensed by the first sensing unit 340 of the main light emitting device 300 is directly transmitted to the central monitoring server 200 through the first communication unit 310. The status information of the sub-light emitting device 400 sensed by the second sensing unit 440 of the sub-light emitting device 400 is transmitted to the central monitoring server 200 through the second communication unit 410.

The second communication unit 410 of the sub-light emitting device 400 performs wireless communication with the first communication unit 310 of the main light emitting device 300 through a local area wireless communication module such as a ZigBee module. In detail, one sub-light emitting device 400*a* receives the status information of the remaining sub-light emitting devices 400*b*, 400*c*, . . . , 400*n*, and simultaneously transmits its status information to the main light emitting device 300 along with the received status information of the remaining sub-light emitting devices 400*b*, 400*c*, . . . , 400*n*. The one sub-light emitting device 400*a* may exchange a command signal or its status information with the main light emitting device 300 through another adjacent sub-light emitting device 400*b*.

The above operation allows the central monitoring server 200 to easily determine whether the battery B included in each of the light emitting devices 300 and 400 is abnormal and whether the light emitting units 320 and 420 require replacement, so that a danger caused by a failure can be prevented by performing a self-diagnosis function.

Since a conventional system for driving light emitting devices is constructed in a wired manner, it has the disadvantages of a complicated construction procedure and high cost required for the implementation of the self-diagnosis function of light emitting devices. However, the system for driving light emitting devices using a wireless communication module according to an embodiment of the present invention can overcome these disadvantages of the conventional system for driving light emitting devices.

Figure 6:
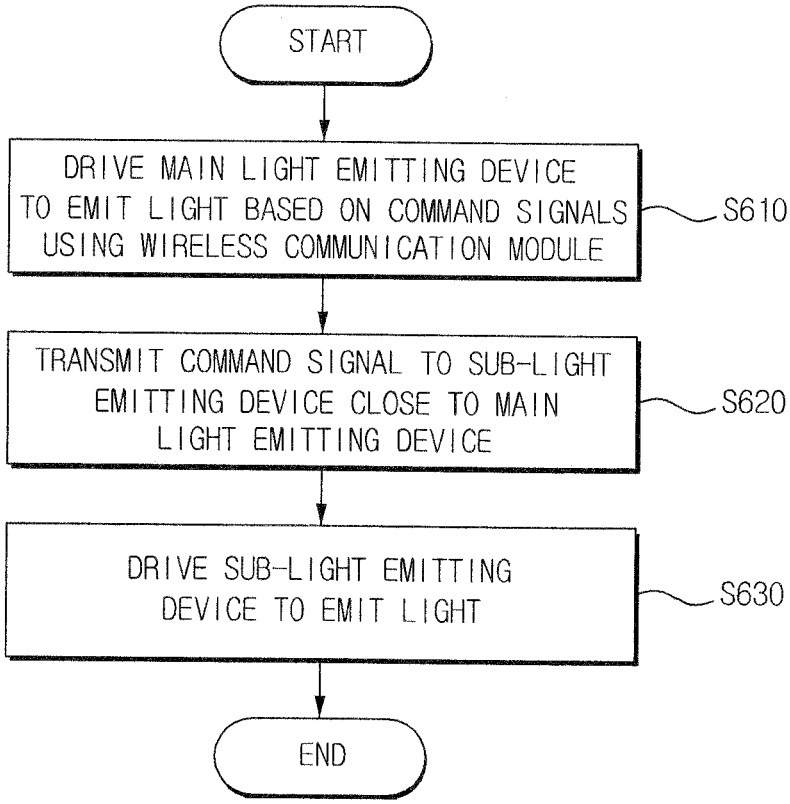
FIG. 6 is a flow chart illustrating a method of driving light emitting devices according to an embodiment of the present invention.

FIG. 6 is a flow chart illustrating a method of driving light emitting devices according to an embodiment of the present invention.

In the method of driving light emitting devices according to an embodiment of the present invention, the main light emitting device 300 is driven to emit light using the wireless communication module based on a command signal received from a central monitoring server 200 at step S610.

Next, a command signal for controlling the sub-light emitting device 400 close to the main light emitting device 300, which belongs to the command signals received from the central monitoring server 200, is transmitted from the main light emitting device 300 to the sub-light emitting device 400 at step S620.

Finally, the sub-light emitting device 400 is driven to emit light in response to the command signal received from the central monitoring server 200 at step S630.

In the method of driving light emitting devices according to the embodiment of the present invention, it is preferred that the central monitoring server 200 and the main light emitting device 300 communicate with each other over a wireless communication network using any one of WCDMA, CDMA, and GSM schemes. It is also preferred that the main light emitting device 300 and the sub-light emitting device 400 communicate with each other using any one of ZigBee, Bluetooth and infrared ray methods.

A method of driving light emitting devices according to another embodiment of the present invention may further include the sensing step of sensing the status of the main light emitting device 300 and the sub-light emitting device 400, and the status information transmission step of transmitting the sensed status information of the main light emitting device 300 and/or the sensed status information of the sub-light emitting device 400 to the central monitoring server 200.

Here, the status information of the main light emitting device 300 and the sub-light emitting device 400 may include information about the batteries B mounted therein, the lifetime information of the first and second light emitting units 320 and 420, and the status information of the second communication unit 410 included in the sub-light emitting device 400. Accordingly, a danger caused by a failure can be prevented by performing the self-diagnosis function of the light emitting devices.

Furthermore, the battery charging step of converting solar energy into electric energy based on the status information of the battery B mounted in each of the light emitting devices 300 and 400 and supplying the electric energy to the battery B may be performed by the central monitoring server 200 or by the light emitting devices 300 and 400 themselves.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A system for driving light emitting devices, comprising: a main light emitting device comprising a first communication unit for exchanging information with a central monitoring server and a close sub-light emitting device using a wireless communication module, a first light emitting unit having at least one light emitting element, and a first control unit for controlling light emission of the first light emitting unit based on command signals received from the central monitoring server, and transmitting a command signal for controlling the sub-light emitting device, which belongs to the command signals received from the central monitoring server, to the sub-light emitting device through the first communication unit; and at least one sub-light emitting device comprises a second communication unit for exchanging information with the main light emitting device, a second light emitting unit having at least one light emitting element, and a second control unit for controlling light emission of the second light emitting unit based on the command signal received from the main light emitting unit, wherein the main light emitting device comprises a first sensing unit for sensing the status information of the first light emitting unit, and the sub-light emitting device comprises a second sensing unit for sensing the status information of the second light emitting unit; and the main light emitting device transmits the status information of the first light emitting unit sensed by the first sensing unit and/or the status information of the second light emitting unit sensed by the second sensing unit and received from the sub-light emitting device to the central monitoring server through the first communication unit, and wherein the status information includes information about a battery mounted in each of the main light emitting device and the sub-light emitting device, lifetime information of the first and second light emitting units, and status information of the second communication unit included in the sub-light emitting device.

2. The drive system as set forth in claim 1, wherein each of the main light emitting device and the sub-light emitting device further comprises a charging module for converting solar energy into electric energy and supplying the electric energy to the battery.

3. The drive system as set forth in claim 1, wherein: the central monitoring server and the main light emitting device communicate with each other over a wireless communication network using any one of Wideband Code Division Multiple Access (WCDMA), Code Division Multiple Access (CDMA), or Global System for Mobile communication (GSM) methods; and the main light emitting device and the sub-light emitting device communicate with each other using any one of ZigBee, Bluetooth, and infrared ray methods.

4. A method of driving light emitting devices using a wireless communication module, comprising: driving a main light emitting device to emit light based on command signals received from a central monitoring server using the wireless communication module; transmitting a command signal for controlling the sub-light emitting device close to the main light emitting device, which belongs to the command signals received from the central monitoring server, to the sub-light emitting device; and driving the sub-light emitting device to emit light in response to the command signal received from the central monitoring server, further comprising: sensing status of the main light emitting device and the sub-light emitting device; and transmitting the sensed status information of the main light emitting device and the sensed status information of the sub-light emitting device to the central monitoring server, wherein the status information includes information about a battery mounted in each of the main light emitting device and the sub-light emitting device, lifetime information of first and second light emitting units, and status information of a second communication unit included in the sub-light emitting device.

5. The drive method as set forth in claim 4, further comprising converting solar energy into electric energy and supplying the electric energy to the battery.

6. The drive method as set forth in claim 4, wherein: the central monitoring server and the main light emitting device communicate with each other over a wireless communication network using any one of WCDMA, CDMA and GSM schemes; and the main light emitting device and the sub-light emitting device communicate with each other using any one of ZigBee, Bluetooth and infrared ray methods.

* * * * *